United States Patent [19]

Wiggs

[11] Patent Number: 4,463,571

[45] Date of Patent: Aug. 7, 1984

[54] DIAGNOSTIC MONITOR SYSTEM FOR HEAT PUMP PROTECTION

[76] Inventor: John W. Wiggs, 5001 E. 68th, Suite 500, Tulsa, Okla. 74136

[21] Appl. No.: 318,695

[22] Filed: Nov. 6, 1981

[51] Int. Cl.[3] ..... F25B 49/00

[52] U.S. Cl. ..... 62/126; 236/94; 324/417

[58] Field of Search ..... 236/94; 165/11; 62/126, 62/127, 129; 361/22; 324/417, 418; 340/520

[56] References Cited

U.S. PATENT DOCUMENTS 4,295,129 10/1981 Cade ..... 236/94

*Primary Examiner*—William E. Wayner

*Attorney, Agent, or Firm*—Head, Johnson & Stevenson

[57] ABSTRACT

A method and apparatus for monitoring the protective circuit associated with a heat pump system wherein both the high pressure switch on the condensor side of the compressor and the low temperature switch on the evaporator side of the compressor are continuously monitored by a low voltage rectifier circuit that relays a signal to a second lock-in relay circuit which in turn initiates and maintains a signal light indicating which switch caused the heat pump system to turn down. Such a device is an inexpensive yet reliable method of diagnosing problems and dangerous conditions with minimum risk to the heat pump.

7 Claims, 2 Drawing Figures

DIAGNOSTIC MONITOR SYSTEM FOR HEAT PUMP PROTECTION

BACKGROUND OF THE INVENTION

1. Field of the Invention

This invention relates to a heat pump protection system. More specifically the invention relates to a diagnostic monitor system for heat pump protection.

2. Description of the Prior Art

The use of a heat pump system, wherein a single unit is employed for both heating and cooling, has in recent years become well established and economically acceptable in many residential and commercial applications. Such a system typically involves a pair of condensor/evaporator coils, one physically located inside the building and the other outside the building, connected to a single motor/compressor wherein the heating versus cooling roles are interchangeable by appropriate valving.

It is generally recognized that there are specific operating limits within which the motor/compressor system must remain in order to prevent damage to the system. Thus it is an accepted practice in the industry to provide the motor/compressor with an electrical protection system. It is known that this system will involve an electric current lock-out relay which is used in series with the low voltage coil of the compressor motor contactor. This contactor interrupts the power supply to the compressor motor when either of two conditions occurs. Usually a 24 volt AC safety circuit is provided to monitor these conditions and includes a high pressure switch on the condensor side of the compressor and a low temperature switch on the evaporator side of the compressor. These respective low voltage switches will open upon experiencing either a high pressure condition, possibly indicating a blockage in the heat pump system, or a low temperature condition, possibly indicating leakage of the refrigerant, and will remain open for a time span, measured in terms of milliseconds, during which the lock-out relay is activated terminating the power to the compressor motor. The high pressure switch or the low temperature switch will then reset itself and thus be ready to again signal a critical condition upon restarting the compressor motor. Various other more elaborate protection systems have been suggested and employed involving time delay restart circuits, current sensing, voltage drop sensing, monitoring other thermal parameters, and the like. However, these systems are directed primarily to protecting the heat pump rather than to diagnostically evaluating what caused the system turndown. Thus, in such cases, the repairman must attach a monitoring device and reinitiate the undesirable event before identifying and repairing a faulty component or condition. This prior art practice has not been completely satisfactory in that it frequently involves repeated trips to the malfunctioning unit and the additional risk of damage in that the system must be restarted before any specific cause of the turndown can be identified with certainty.

SUMMARY OF THE INVENTION

In view of the deficiencies associated with the prior art apparatus and procedures, I have discovered an economical method of modifying a contemporary heat pump system such that the high pressure switch and the low temperature switch and any additional protective switches can be continuously monitored and upon turndown of the heat pump a diagnostic message as to which switch was responsible will remain. Accordingly, the present invention provides a method and apparatus for monitoring the protective circuitry of a heat pump system, wherein the protective circuitry involves activating a lock-out relay in response to a warning signal originating from either a high pressure switch or a low temperature switch thus terminating current to the compressor motor of the heat pump system, comprising the steps of and means for:

(a) sensing the operation of the high pressure switch when the high pressure switch creates a warning signal that activates the lock-out relay terminating current to the compressor motor;

(b) supplying power to an electrical circuit, in response to sensing the event of step (a), that identifies the high pressure switch as having created the warning signal;

(c) sensing the operation of the low temperature switch when the low temperature switch creates the warning signal that activates the lock-out relay terminating current to the compressor motor; and (d) supplying power to an electrical circuit, in response to sensing the event of step (c), that identifies the low temperature switch as having created the warning signal, thus discriminating between the high pressure switch and the low temperature switch as the source of the signal that activated the lock-out relay.

The present invention further provides for the sensing operations to be performed by rectifying the signal across the activated high pressure switch or low temperature switch thus closing a relay and creating a low voltage DC signal to a second relay. This second relay is part of an electrical circuit that identifies which of the switches has been activated by locking in a power supply to maintain a signal light. The present invention also provides that the monitoring system be permanently attached to the protective circuitry or reversibly attached as a diagnostic unit. In the broadest sense the present invention provides such a diagnostic unit to monitor a plurality of separate switches responsive to separate events that activate a lock-out relay for terminating current to any apparatus wherein the separate switches automatically reset after the occurrence of the event.

Thus it is a primary object of the present invention to provide an inexpensive and reliable method and apparatus to monitor the protective circuitry of a heat pump system or the like. It is a further object of the present invention to provide a diagnostic tool that distinguishes between the events that caused the heat pump system's protective circuitry to turn off the system. Fulfillment of these objects and the presence and fulfillment of other objects will be apparent upon complete reading of the specification taken in conjunction with the attached drawing and claims.

DESCRIPTION OF THE PREFERRED EMBODIMENTS

The diagnostic monitoring system of the present invention, how it interrelates to the conventional protective circuitry of a heat pump system, how it operates, and the advantages over the prior art can perhaps be best explained and understood by reference to the accompanying drawings.

Figure 1:
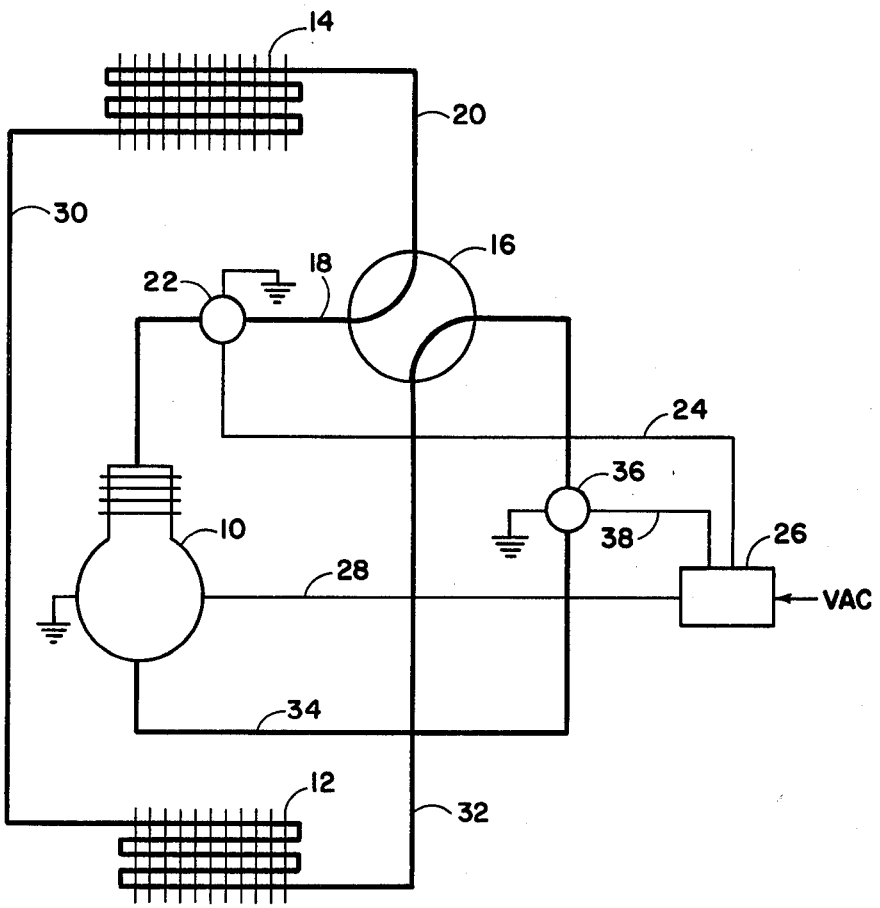
FIG. 1 is a simplified illustration of a conventional heat pump system with protective circuitry showing the relative positions of the high pressure switch, low temperature switch, and lock-out relay.

FIG. 1 is a simplified illustration of the major components of a conventional heat pump system made up of a motor/compressor unit 10, a pair of interchangeable condensor/evaporator units 12 and 14, and a reversing valve 16. During operation of the heat pump system, refrigerant is liquified by compression in the motor/compressor unit 10 and delivered (as illustrated) to condensor/evaporator unit 14 via conduit 18, reversing valve 16, and conduit 20. The liquid refrigerant exiting the high pressure side of compressor unit 10 passes through a high pressure sensing switch 22 which continuously monitors the pressure. In the event of sensing a dangerously high pressure (possibly indicating a restriction or blockage in the refrigerant system), the high pressure switch 22 opens briefly sending a signal back, via line 24, to the heat pump system's protective circuitry 26. Upon receiving the signal a lock-out relay (not shown) terminates the electrical current to motor/compressor unit 10 previously delivered via line 28. Upon cessation of power to the motor/compressor unit 10 the high pressure switch automatically resets for future protection of the heat pump system while the lock-out relay has to be manually reset by the serviceman.

As illustrated, the refrigerant evaporates in condensor/evaporator 14 (absorbing heat energy) and then continues through conduit 30 to condensor/evaporator 12 whereupon the gas is cooled before recycling to the inlet of motor/compressor unit 10 via conduit 32, reversing valve 16, and conduit 34. The refrigerant returning to the inlet of the compressor 10 passes through a low temperature sensing switch 36 which continuously monitors the temperature. In the event of sensing a dangerously low temperature (possibly indicating refrigerant leakage) the low temperature switch 36 opens briefly sending a signal back, via line 38, to the heat pump system's protective circuitry 26. Again, upon receiving the signal the lock-out relay terminates the electrical current to the motor/compressor unit 10 and the low temperature switch resets for future low temperature events. In this manner the motor/compressor unit 10 is protected, independent of the position of the reversing valve and the relative (interchangeable) roles of the condensor/evaporator units 12 and 14. However, such a protective system does not distinguish between a high pressure condition and a low temperature condition. Thus the repairman upon service of the heat pump unit after turndown must install temporary diagnostic equipment and then reinitiate the entire event before any objective data related to the cause of the turndown can be established. Such a process is time consuming and subjects the heat pump unit to additional risk.

Figure 2:
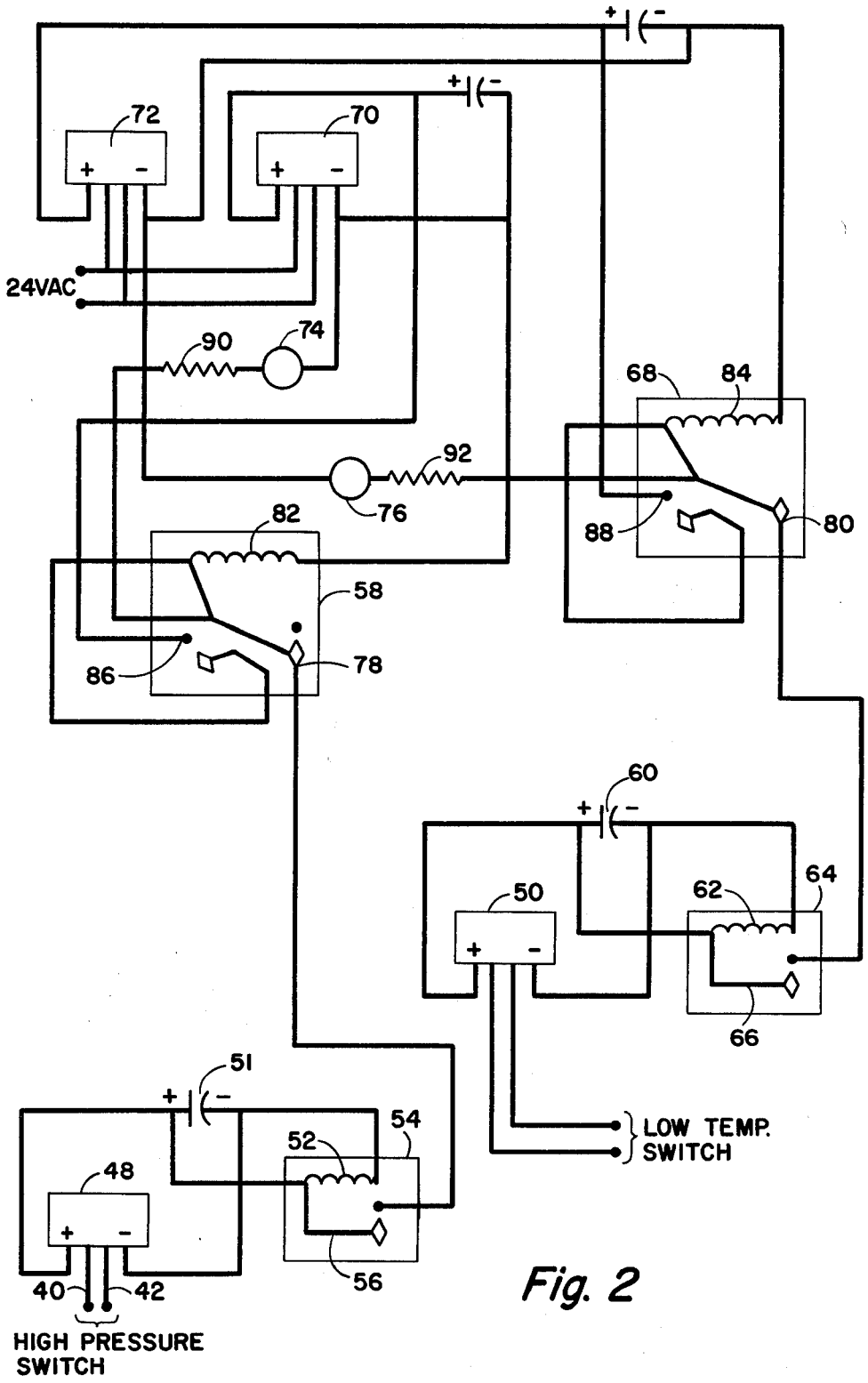
FIG. 2 is a schematic wiring diagram of the monitor system according to the present invention.

FIG. 2 schematically illustrates the improved electrical monitoring system of the preferred embodiment of the present invention. According to this preferred embodiment a pair of leads 40 and 42 are permanently attached across the high pressure switch 22 of FIG. 1 while another pair of leads 44 and 46 are similarly attached across the low temperature switch 36. Upon opening of either the high pressure switch 22 or the low temperature switch 36, a low voltage signal, usually 24 v.a.c., will exist for a time span of the order of milliseconds. This signal will be rectified by rectifier 48 or 50 depending on whether the signal originated at the high pressure or at the low temperature switch. Separate capacitive/relay sensing circuits are individually provided to recognize which source switch has opened. In the case of the high pressure switch the rectified signal from recifier 48 performs two functions; first, by virtue of the already closed circuit involving capacitor 51 and activator element 52 of relay 54, the current will activate the movable contact element 56 of relay 54 thus completing the circuit between relay 54 and relay 58, and second, the signal will lock in a signal light (as explained later). Similarly, in the case of the low temperature switch the rectified signal from rectifier 50 passes through the parallel capacitor 60/activator element 62 circuit thus activating the movable element 66 of relay 64 and completing the circuit between relays 64 and 68.

A separate 24 v.a.c. supply is provided as power to a second pair of rectifiers 70 and 72. The rectified low voltage DC power from rectifiers 70 and 72 supply current to either a high pressure warning light 74 or to a low temperature warning light 76 of two separate respective identification circuits. Each identification circuit involves a capacitor/dual pole lock-in relay and a resistive warning light circuit. Initially, each identification circuit is in the off or open circuit configuration as illustrated in FIG. 2. Upon activation of either sensing circuit as previously described, the signal received at the closed contact 78 of lock-in relay 58 or the closed contact 80 of lock-in relay 68 will complete the circuit from the plus terminal of rectifier 48 or 50 and the respective negative terminal of rectifier 70 or 72 through a corresponding activator element 82 or 84. The current associated with this signal will activate both movable elements of the respective relay 58 or 68 thus opening the circuit between the previously sensing circuit (relay 54 or 64) and identifying circuit (relay 58 or 68). However, after once initiating either relay 58 or 68, the 24 volt DC power from rectifier 72 or 70 will take over and lock in the corresponding relay. In other words, having once repositioned the movable pair of elements of relay 58 or 68 off the contact points, the completed circuit at contacts 86 and 88 will maintain a current flow through the activator element 82 or 84 (respectively) and thus lock in the relay. This same lock-in position completes the circuit through resistor 90 and high pressure warning light 74, or resistor 92 and low temperature warning light 76. The respective light will then remain on, thus serving to identify which switch caused the heat pump system to be turned off. This identifying light remains on until the serviceman physically turns off the independent 24 v.a.c. power source to rectifiers 70 and 72 (unplugs the heat pump system entirely) whereupon the relays 58 and 68 will reset.

In testing the above monitor system, a prototype circuit according to the schematic of FIG. 2 was prepared using the following commercially available components:

| # | MANUFACTURER | PART NUMBER | COMPONENT |
|---|---|---|---|
| 2 | AMF POTTER & BRUMFIELD | T10-E2-Y2-24 VDC | RELAY |
| 2 | AMF POTTER & BRUMFIELD | R50S-E2-Y1-24 VDC | RELAY |
| 4 | AMF POTTER & BRUMFIELD | FW200 MAL 8017 P AC | RECTIFIER |
| 2 | DELCON | 100U 35V | CAPACITOR |
| 2 | DELCON | 25U 35V | CAPACITOR |

The monitoring system was physically attached to commercially available heat pump controls and has proven to be highly reliable in distinguishing which condition caused the heat pump system to turn off.

Having thus described the invention with a certain degree of particularity, it is manifest that many changes can be made in the details of construction and arrangement and selection of components without departing from the spirit and scope of this disclosure. Thus, the monitoring system is viewed as being consistent with any arbitrary number of automatically resetting protective switches that terminate the power to an electrical apparatus. It is also viewed as being either an integral part of the protective system, an add-on item, or a separate attachable diagnostic tool. Further, the specific position of the rectification step (if needed at all) or in fact the use of batteries is contemplated as being equivalent. Therefore, it is to be understood that the invention is not limited to the embodiment set forth herein for purposes of exemplification, but is to limited only by the scope of the attached claims, including a full range of equivalents to which each element thereof is entitled.

I claim:

1. A method for monitoring protective circuitry for a heat pump system, wherein said circuitry involves activating a lock-out relay in response to a warning signal originating from either a high pressure switch or a low temperature switch thus terminating current to the compressor motor of said heat pump system, comprising the steps of:

(a) sensing the operation of said high pressure switch when said high pressure switch creates said warning signal that activates said lock-out relay terminating current to said compressor motor;

(b) supplying power to an electrical circuit, in response to sensing the event of step (a), that identifies said high pressure switch as having created said warning signal;

(c) sensing the operation of said low temperature switch when said low temperature switch creates said warning signal that activates said lock-out relay terminating current; and (d) supplying power to an electrical circuit, in response to said sensing of the event of step (c), that identifies said low temperature switch as having created said warning signal, thus discriminating between the high pressure switch and the low temperature switch as the source of the signal that activated said lock-out relay.

2. A method for monitoring protective circuitry for a heat pump system of claim 1 wherein said sensing operations are performed by rectifying the signal across the activated high pressure switch or low temperature switch thus closing a relay and creating a low voltage DC signal to a second relay and wherein said supplying power to an electrical circuit that identifies which of said switches has been activated involves said second relay locking in a separate circuit that turns on a light thus resulting in said discrimination.

3. A method of claim 2 wherein said monitoring system is permanently attached to said protective circuitry.

4. A method of claim 2 wherein said monitoring system is permanently attached to said protective circuitry.

5. An apparatus for monitoring protective circuitry for a heat pump system, wherein said circuitry involves activating a lock-out relay terminating current to the compressor motor of said heat pump system in response to a warning signal from either a high pressure switch or a low temperature switch comprising:

(a) a means for sensing the operation of said high pressure switch when said high pressure switch creates said warning signal that activates said lock-out relay terminating current to said compressor motor;

(b) a means, responsive to said sensing of the operation of said high pressure switch of step (a), for identifying said high pressure switch operation;

(c) a means for sensing the operation of said low temperature switch when said low temperature switch creates said warning signal that activates said lock-out relay terminating current; and (d) a means, responsive to said sensing of the operation of said low temperature switch of step (c), for identifying said low temperature switch operation, thus discriminating between the high pressure switch and the low temperature switch as the source of the signal that activated said lock-out relay.

6. An apparatus of claim 5 wherein said means for sensing operations of said high pressure switch and said low temperature switch further comprises a means for rectifying the signal across the respective activated switch thus creating a DC signal and wherein said means responsive to said sensing operations further comprises a relay responsive to said DC signal for supplying and maintaining power to an electrical circuit which identifies which of said switches has been activated.

7. An apparatus of claim 6 wherein said relay responsive to said DC signal supplies and maintains power to a separate circuit containing a light.

* * * * *